US006807715B1

(12) United States Patent
Blair

(10) Patent No.: US 6,807,715 B1
(45) Date of Patent: Oct. 26, 2004

(54) RETAINING STRAP

(75) Inventor: James F. L. Blair, Shannon, IL (US)

(73) Assignee: Saint Technologies, Inc., Shannon, IL (US)

( * ) Notice: Subject to any disclaimer, the term of this patent is extended or adjusted under 35 U.S.C. 154(b) by 0 days.

(21) Appl. No.: 10/313,140

(22) Filed: Dec. 9, 2002

(51) Int. Cl.[7] ..... B65D 63/00

(52) U.S. Cl. ..... 24/16 PB; 24/17 A; 24/300

(58) Field of Search ..... 24/16 PB, 16 R, 24/17 A, 18, 300, 481, 482, 30.5 R, 30.5 P

(56) References Cited

U.S. PATENT DOCUMENTS 4,037,603 A * 7/1977 Wendorff ..... 606/157
4,466,159 A * 8/1984 Burrage ..... 24/16 PB
5,987,706 A * 11/1999 Boe ..... 24/16 PB

* cited by examiner

*Primary Examiner*—Robert J. Sandy
(74) *Attorney, Agent, or Firm*—Kajane McManus

(57) ABSTRACT

The retaining strap comprises a thin, elongate piece of expandable and non marring material having a plurality of spaced apart longitudinal slots therein to which objects, via retainers, can be engaged. The retaining strap also has terminal connectors thereon for securing the strap to itself and/or other objects to be engaged thereby.

11 Claims, 1 Drawing Sheet

RETAINING STRAP

BACKGROUND OF THE INVENTION

1. Field of the Invention

The present invention relates to a retaining strap. More particularly the strap is made of a material which is capable of longitudinal expansion and includes a plurality of spaced apart longitudinal slots therein to which the strap itself can be bound or for use with other objects such as hooks, washers, attachment rings, etc. to assist in retaining an object.

2. Prior Art

Heretofore various forms of retaining straps have been proposed.

One well known form of such retaining strap is commonly referred to as a bungee cord.

As will be described in greater detail hereinbelow, the retaining strap of the present invention provides advantages which prior art straps are incapable of accomplishing.

SUMMARY OF THE INVENTION

According to the invention there is provided a retaining strap comprising an elongate body made of longitudinally expandable material and having a plurality of spaced apart slots disposed longitudinally along the body, the strap further including a connector at each end thereof which engages within a slot to engage the strap to itself or to engage an object to be retained by the strap.

DESCRIPTION OF THE PREFERRED EMBODIMENT

Figures 1, 2, 3, 4, 5, 6:
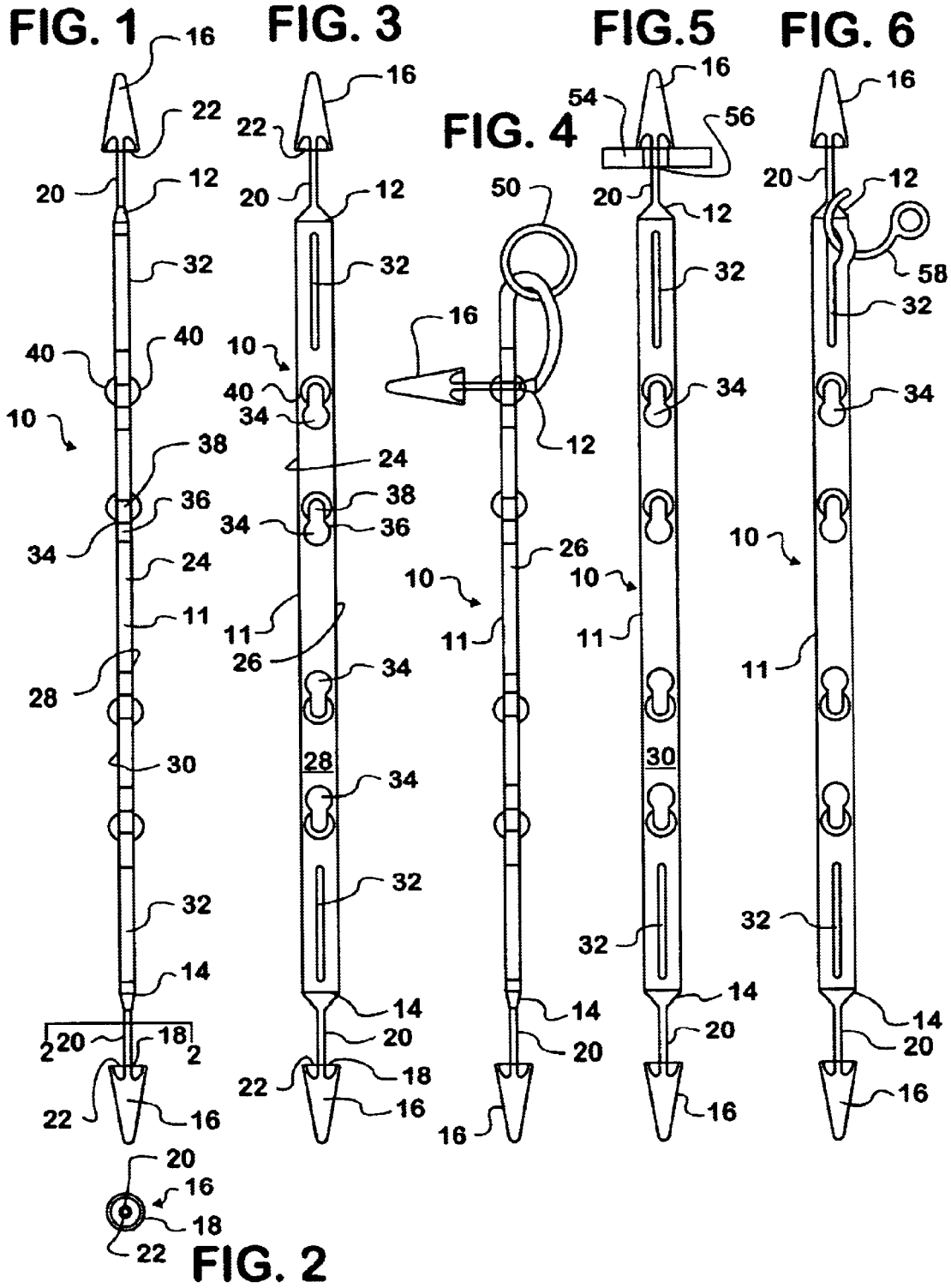
FIG. 1 is a perspective side view of the retaining strap of the present invention.
FIG. 2 is an end view taken along line 2—2 of FIG. 1.
FIG. 3 is a perspective top view of the strap of FIG. 1.
FIG. 4 is a perspective side view showing an attachment ring secured to the strap.
FIG. 5 is a perspective view showing a washer secured to one end of the strap.
FIG. 6 is a perspective top view showing a hook engaged to an elongate end slot of the strap.

Referring now to the drawings in greater detail, there is illustrated therein the retaining strap made in accordance with the teachings of the present invention and generally identified by the reference numeral 10.

The strap 10 is preferably made of a non marring, expandable material and includes an elongate, flattened body 11 having two ends 12 and 14 each of which in turn includes a terminal connector 16 mounted thereon.

The terminal connector 16 is conical with a base 18 of the conical connector 16 being engaged to the body 11 of the strap 10 by a thin shaft 20.

As best illustrated in FIG. 2, the base 18 of the conical connector 16 has a circular groove 22 therein surrounding the point of attachment of the shaft 20 thereof, making the base 18 inwardly flexible.

Longitudinally inwardly of the shaft 20 at each end 12, 14 of body 11, the body 11 flattens out, having narrower side surfaces 24 and 26 respectively, as compared to identical top and bottom surfaces 28 and 30, respectively, thereof.

Extending through the body 11, toward each end 12 and 14 a centered longitudinal slot 32 is provided extending through the body 11 from the top surface 28 to the bottom surface 30.

Provided next, longitudinally inwardly of each elongate slot 32, is a pair of spaced apart keyhole slots 34, each keyhole slot 34 comprising a large opening portion 36 with a stepped down opening portion 38 of each keyhole slot 34 being positioned longitudinally inwardly of the stepped down opening portion 38. The keyhole slots 34 also extend through the body 11 from the top surface 28 to the bottom surface 30.

Each stepped down opening portion 38 of each keyhole slot 34 is surrounded by an elevated lip or ridge 40 which, in the preferred embodiment, is semicircular on both the top and bottom surfaces 28 and 30, respectively.

It will be understood that the keyhole slots 34 may be used to connect a portion of the strap 10, to itself, as best illustrated in FIG. 3, and thus the large opening portion 36 of each slot 34 must be of a size sufficient to allow passage of the conical connector 16 therethrough while the stepped down opening portion 38 must be large enough to accommodate engagement of the shaft 20 therein but too small to allow passage of the conical connector 16.

It will further be understood that the lip or ridge 40 surrounding the stepped down opening portion 38 of each slot 34 should be of a size to allow the circular groove 22 of the conical connector 16 to seat thereupon, providing an effective means for "locking" the conical connector 16 in place, against accidental release.

When release is desired, the conical connector 16 is unseated, from over the stepped down opening portion 38, moved into the larger opening portion 36, and slid therethrough.

If desired the larger opening portion 36 could be made slightly smaller than the base 18 of the conical connector 16 since provision of the circular groove 22 therein allows for some flexibility to the base 18, and thus ensures further against accidental release, though this should not be construed as limiting.

Such self-engageability of the strap 11 allow for same to be effectively engaged to a securement 50 of an object to be retained, the securement 50 in FIG. 4 being illustrated to take the form of a ring 50.

Turning now to FIG. 5, it will be seen that the conical connector 16 can also be used to engage the strap 10 to a ring element 54, such as a washer 54, which is at times found strengthening an opening in an object such as a tarpaulin (not shown), so long as the opening 56 in the ring element 54 is smaller than the base 18 of the conical connector 16.

Further, in FIG. 6, it is shown that any of the slots 32 or 34, and in this particular instance, the longitudinal slot 34, can also be used to engage the retaining strap 10, in suitable manner, to an item incorporating its own retainer 58, such as a hook 58 often found on an object such as a tent (not shown).

As described above, the strap 10 provides a number of advantages, some of which have been described above and others of which are inherent in the invention. Also, modifications may be proposed to the strap 10 without departing from the teachings herein. Accordingly the scope of the invention is only to be limited as necessitated by the accompanying claims.

What is claimed is:

1. A retaining strap comprising an elongate body made of longitudinally expandable material and having a plurality of spaced apart slots disposed longitudinally along the body, an elongate end slot being provided in the strap toward each end thereof, and a plurality of spaced apart keyhole slots each having a larger opening portion and a stepped down portion are provided in the strap between the elongate end slots, the strap further including a connector at each end thereof extending longitudinally therefrom which engages within a slot to engage the strap to itself or to engage an object to be retained by the strap.

2. The strap of claim 1 wherein each stepped down portion includes a peripheral raised lip therearound.

3. The strap of claim 2 wherein each stepped down portion is longitudinally outwardly positioned relative to the larger opening portion.

4. The strap of claim 3 wherein each connector of the strap has a conical configuration having a base.

5. The strap of claim 4 wherein the base of each connector is engaged to an end of the strap by a shaft.

6. The strap of claim 5 wherein the base of each connector has a circular groove therein surrounding the shaft.

7. The strap of claim 6 wherein the base of each connector is sized to pass through the larger opening portion of the keyhole slots.

8. The strap of claim 7 wherein the shaft of each connector is receivable within the stepped down portion of each keyhole slot but the connector cannot pass therethrough.

9. The strap of claim 8 wherein the groove in base of the connector is sized to seat upon and engage the peripheral lip of the stepped down portion of the keyhole slot.

10. The strap of claim 1 being made of a non marring material.

11. The strap of claim 1 being flexible.

* * * * *